US009200419B2

(12) United States Patent
Winter et al.

(10) Patent No.: US 9,200,419 B2
(45) Date of Patent: Dec. 1, 2015

(54) RUNWAY SNOWBLOWER

(71) Applicant: Wausau Equipment Company, Inc., New Berlin, WI (US)

(72) Inventors: Rodney C. Winter, Dousman, WI (US); Ted N. Tadysak, Milwaukee, WI (US); Josh Heinz, Fond du Lac, WI (US); Hector Baez, Fond du Lac, WI (US); Peter Tiffe, Brookfield, WI (US); Alan Fillman, Racine, WI (US)

(73) Assignee: Wausau Equipment Company, Inc., New Berlin, WI (US)

( * ) Notice: Subject to any disclaimer, the term of this patent is extended or adjusted under 35 U.S.C. 154(b) by 0 days.

(21) Appl. No.: 13/779,213

(22) Filed: Feb. 27, 2013

(65) Prior Publication Data

US 2014/0237863 A1 Aug. 28, 2014

(51) Int. Cl.
*E01H 5/09* (2006.01)
*E01H 5/07* (2006.01)

(52) U.S. Cl.
CPC ..... *E01H 5/076* (2013.01)

(58) Field of Classification Search
USPC ..... 37/209, 210, 213, 242, 244, 248, 250, 37/253–256
IPC ..... E01H 5/09,5/094, 5/096, 5/098
See application file for complete search history.

(56) References Cited

U.S. PATENT DOCUMENTS

| | | | | | |
|---|---|---|---|---|---|
| 403,665 | A | * | 5/1889 | Haughawout | 37/209 |
| 421,841 | A | * | 2/1890 | Scheffler | 37/210 |
| 436,204 | A | * | 9/1890 | Bergendahl | 37/209 |
| 685,193 | A | * | 10/1901 | Weniger | 37/210 |
| 2,154,353 | A | * | 4/1939 | Ploetz | 37/250 |
| 2,681,516 | A | * | 6/1954 | Bourne | 37/256 |
| 2,732,638 | A | * | 1/1956 | Leufvenius | 37/256 |
| 2,770,893 | A | * | 11/1956 | Jacobs | 37/256 |
| 2,971,279 | A | * | 2/1961 | Blanchet | 37/256 |
| 3,043,027 | A | * | 7/1962 | Ruffing | 37/236 |
| 3,085,832 | A | * | 4/1963 | Guillemette | 37/256 |
| 3,750,758 | A | * | 8/1973 | Bancel | 172/58 |
| 3,755,931 | A | | 9/1973 | Gisler | |
| 4,057,915 | A | * | 11/1977 | Schmidt, Jr. | 37/256 |
| 4,100,687 | A | | 7/1978 | Jeswine | |
| 4,143,475 | A | | 3/1979 | Schmidt et al. | |
| 4,151,663 | A | | 5/1979 | Schmidt | |
| 4,261,116 | A | | 4/1981 | Kahlbacher | |
| 4,346,527 | A | | 8/1982 | Schmidt | |

(Continued)

OTHER PUBLICATIONS

TS 5 Snowblower turbostream brochure, Schmidt Engineering & Equipment Co. Ltd, 268/EB 41280 (applicant admitted prior art).

*Primary Examiner* — Gary Hartmann

(74) *Attorney, Agent, or Firm* — Andrus Intellectual Property Law, LLP

(57) ABSTRACT

A snowblower assembly for removing snow from a paved surface, such as roadways and airport runways. The snowblower assembly includes a snowblower assembly that defines an open interior that encloses a pair of rotating side augers and a rotating impeller. The snowblower housing includes a lower leading edge that is recessed behind the blade tips of the rotating impeller. The sidewalls of the snowblower housing each include a recessed lower sidewall edge to reduce the buildup of snow within the snowblower housing. A side plate extension is mounted to each of the sidewalls to modify the volume of the open interior defined by the snowblower housing to accommodate different types of snow.

7 Claims, 12 Drawing Sheets

(56) References Cited

U.S. PATENT DOCUMENTS

| | | | | |
|---|---|---|---|---|
| 4,592,156 | A * | 6/1986 | Schmidt | 37/250 |
| 4,715,134 | A | 12/1987 | Schmidt | |
| 4,829,684 | A | 5/1989 | Gruber | |
| 5,209,003 | A | 5/1993 | Maxfield et al. | |
| 5,379,672 | A * | 1/1995 | Thomas | 83/837 |
| 6,266,598 | B1 | 7/2001 | Pillar et al. | |
| 7,100,311 | B2 | 9/2006 | Verseef | |
| 7,305,777 | B2 * | 12/2007 | Kettering et al. | 37/233 |
| 2012/0192464 | A1 | 8/2012 | Winter et al. | |
| 2013/0291411 | A1 * | 11/2013 | Cmich et al. | 37/251 |

* cited by examiner

RUNWAY SNOWBLOWER

BACKGROUND

The present disclosure generally relates to a high speed snowblower. More specifically, the present disclosure relates to a high speed runway snowblower that includes a pair of augers positioned on opposite sides of a center impeller that allows the snowblower to remove snow from a paved surface, such as a roadway or runway at relatively high speeds.

High speed snowblowers are particularly useful in clearing long stretches of pavement, such as an airport runway. In a typical application, multiple plows or rotating brooms are used to direct snow toward the side of a runway. A snowblowing machine is then used to move the piled snow away from the runway and onto the infield of the airfield.

Presently, plows and brooms can be operated at speeds much higher than the speed at which currently available truck-mounted snowblowers can remove the snow from the runway. Thus, the snowblowing equipment is the limiting factor for the amount of time needed to remove snow from a runway.

SUMMARY

The present disclosure generally relates to a snowblower for removing snow from paved surfaces, such as roads, or runways. The snowblower of the present disclosure includes a snowblower assembly having a pair of rotating side augers that direct snow toward a center impeller. The center impeller rotates and draws snow into a volute assembly where it is thrown into and through a discharge chute. The forward motion of the snowblower vehicle helps to feed snow into the snowblower housing.

The snowblower assembly includes a snowblower housing that defines an open interior defined at a top end by an upper hood extending between a pair of sidewalls. The upper hood defines the top edge of the snowblower housing and extends from a leading edge to a trailing edge. When installed on the snowblower assembly, the upper hood of the present disclosure decreases in height from the trailing edge to the leading edge to provide enhanced visibility for the driver of the vehicle to which the snowblower assembly is mounted.

Each of the side augers is driven by a hydrostatic drive motor. In accordance with the disclosure, the hydrostatic drive motor for each of the side augers is positioned outside of the open interior defined by the snowblower housing and thus above the upper hood. With the hydrostatic drive motors for each of the side augers positioned outside of the open interior of the snowblower housing, the motors cannot interfere with or otherwise obstruct snow as it is processed within the snowblower housing.

The lower leading edge of the snowblower housing is recessed relative to the sidewall edges and the upper leading edge of the snowblower housing such that the blades of the center, rotating impeller, and the side augers extend past the lower leading edge. The recessed lower leading edge aids in preventing a buildup of snow in front of the rotating impeller and the rotating side augers.

The center impeller is designed to have blade tips that each extend past the lower leading edge of the snowblower housing. The extending blade tips aid in gathering snow that may otherwise accumulate in front of the snowblower housing during use of the snowblower assembly.

Since the impeller blades are designed to extend past the lower leading edge, each of the side augers positioned within the snowblower housing are specifically designed to include tapered auger blades that have a width that decreases from a lower end to an upper end. The tapered blade on each of the side augers prevents the impeller blades from contacting the auger blades during operation.

In order to prevent the buildup of snow within the snowblower housing, the opposite sidewalls are designed having a lower sidewall edge that is recessed from the upper leading edge of the snowblower housing. The recessed lower sidewall edge prevents the buildup of snow within the snowblower housing in front of the rotating side augers. The lower sidewall edge is generally aligned with the side augers to prevent the buildup of snow on the sides of the snowblower housing as compared to prior art snowblower assemblies.

In accordance with one embodiment of the disclosure, each of the sidewalls of the snowblower housing can include a side plate extension. The side plate extension is selectively extendable past the recessed lower sidewall edge in order to entrap a greater volume of snow within the snowblower housing. The side plate extension allows the user to selectively increase the volume of snow that can be contained within the snowblower housing. The use of the side plate extensions aids in entrapping snow when the snowblower assembly is used with relatively dry, low density snow while allowing the user to retract the side plate extensions when the snowblower assembly is used with relatively wet, high density snow. Preferably, the pair of side plate extensions can be extended independently relative to each other such that one or both of the side plate extensions could be in either the retracted position or the extended position.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
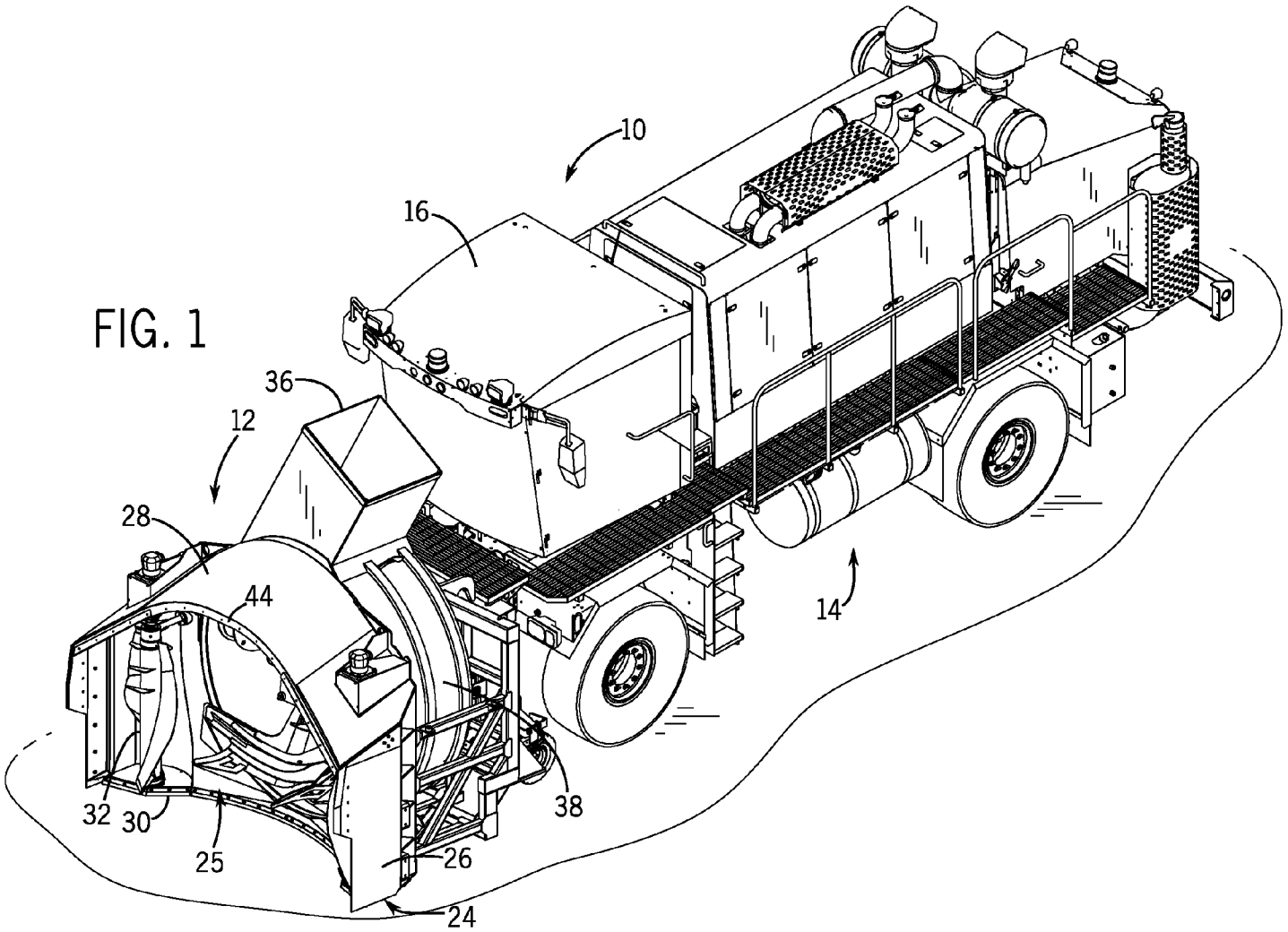
FIG. 1 is a perspective view of a truck including a truck-mounted snowblower assembly of the present disclosure.
Figure 2:
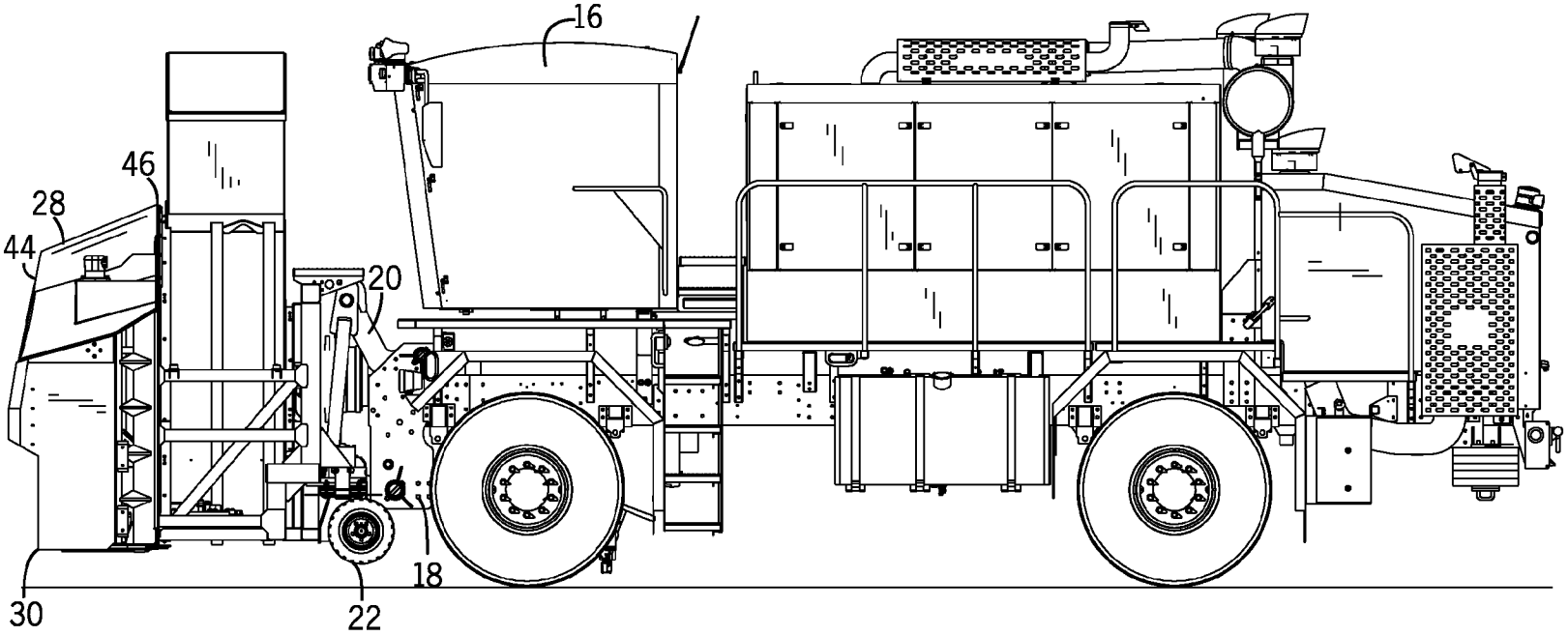
FIG. 2 is a side view of the truck and snowblower assembly.

FIG. 1 is a perspective view of a snowblower 10 that includes a high speed snowblower assembly 12 mounted to the front end of a vehicle or truck 14. The vehicle 14 includes a cab 16 positioned above the snowblower assembly 12 such that the driver of the vehicle 14 can view the pavement being cleared of snow. As illustrated in FIG. 2, the cab 16 is positioned at the front end of the vehicle 14 to provide the operator with the adequate viewing position to direct the snowblower 10 as needed.

The snowblower assembly 12 is mounted to the front end 18 of the vehicle 14 through a mechanical linkage 20 that allows the operator of the vehicle to lift the snowblower assembly 12 off of the ground when desired. The snowblower assembly 12 includes a pair of caster wheels 22 and a front, lower leading edge 30 of the snowblower assembly. The height of the front, lower leading edge 30 is adjustable through adjustments to the caster wheels 22.

Referring back to FIG. 1, the snowblower assembly 12 includes a snowblower housing 24 that creates an open interior 25 defined by a pair of sidewalls 26, a curved upper hood 28 that defines an upper leading edge 44 and the shaped lower leading edge 30. The lower leading edge 30 directs snow from the ground into the open interior 25 of the snowblower housing 24 while the upper leading edge 44 defines the internal volume of the snowblower housing 24. In the embodiment shown in FIG. 1, the sidewalls 26 define the width of a clearing path for the snowblower 10. In the embodiment shown in FIG. 1, the clearing path is 118 inches, although other widths are contemplated.

Figure 3:
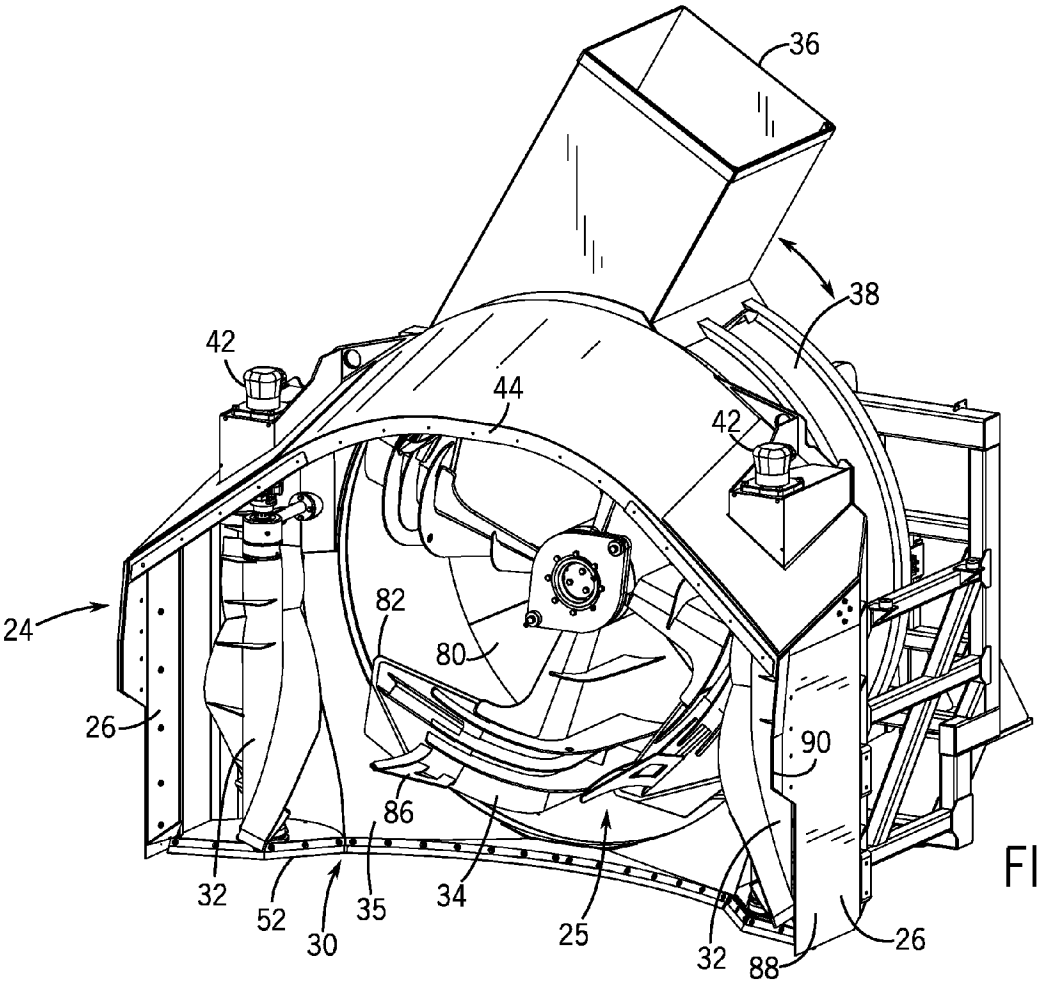
FIG. 3 is a front perspective view of the snowblower assembly removed from the truck.

As illustrated in FIGS. 1 and 3, a pair of side augers 32 are positioned inward of each of the sidewalls 26. The pair of side augers 32 each rotate in opposite directions to direct snow toward the center of the snowblower assembly 12.

As shown in FIG. 3, the snowblower assembly 12 further includes a rotating impeller 34 having a diameter of 82 inches. The impeller 34 extends through a back wall 35 of the snowblower housing 24 and rotates within open interior 25 of the snowblower assembly 12 and directs a flow of snow out of a discharge chute 36. Referring back to FIG. 1, the discharge chute 36 forms part of a volute assembly 38. As shown by the arrow in FIG. 3, the volute assembly 38 is rotatable to adjust the position of the discharge chute 36. The position of the discharge chute 36 can be adjusted to direct snow to either side of the snowblower vehicle at various angles relative to the snowblower 10.

Figure 4:
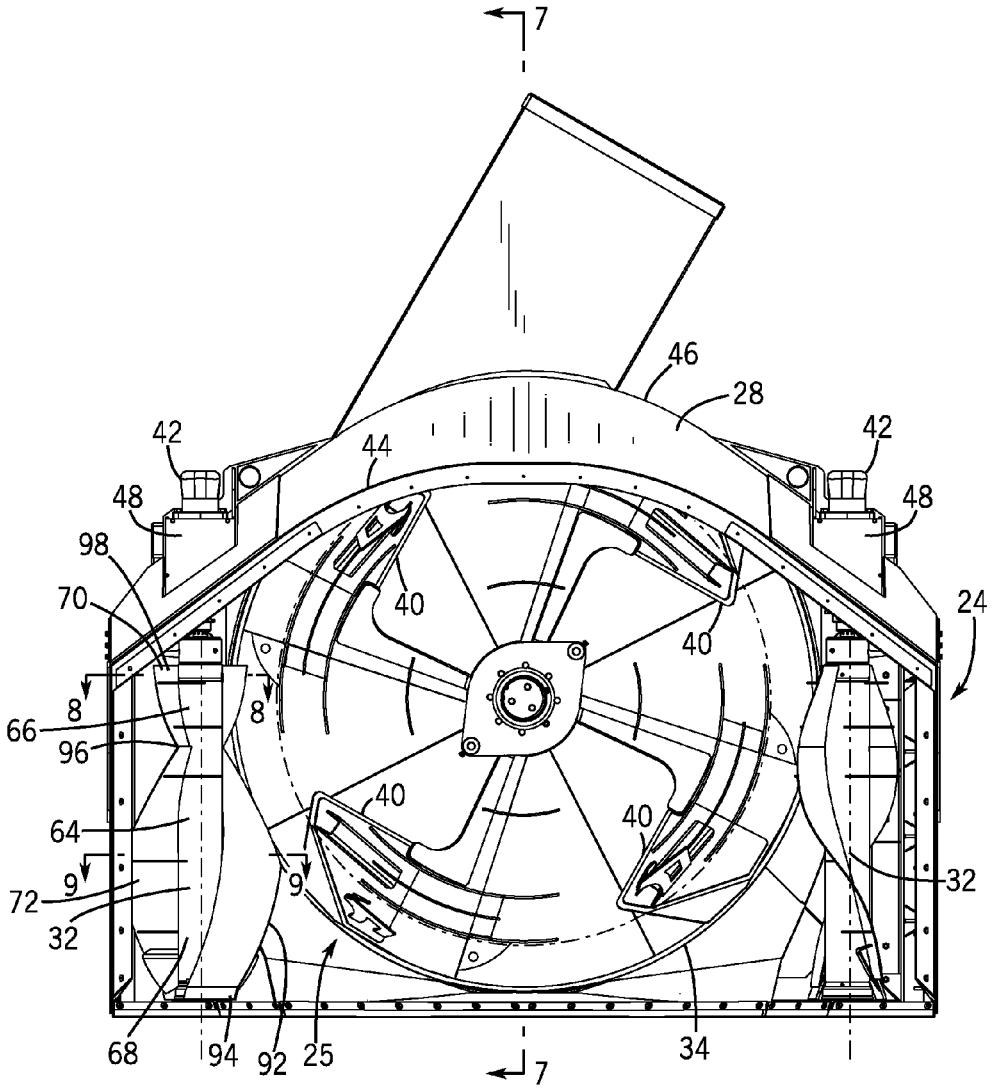
FIG. 4 is a front view of the snowblower assembly.

Referring to FIG. 4, the impeller 34 includes four blades 40 that collect the snow being cleared and throw the snow into and through the discharge chute 36 and away from the snowblower 10. Although only four impeller blades 40 are shown on the impeller 34, the impeller could also include five blades in an alternate configuration.

Referring now to FIG. 3, each of the rotating side augers 32 includes a separate drive motor 42 used to rotate the auger 32. The separate drive motors 42 rotate the augers 32 using a supply of hydraulic fluid provided to the respective drive motor 42 through a supply line from a power source on the vehicle. The power source used to drive the augers 32 is separate from the power source used to rotate the impeller 34. In this manner, the drive force created by the motors 42 does not draw power from the drive force required to rotate the impeller 34, unlike prior art systems in which the power used to rotate the augers 32 was taken from the same power source used to rotate the impeller 34. A hydraulic fluid return line returns the hydraulic fluid to the truck.

Figure 5:
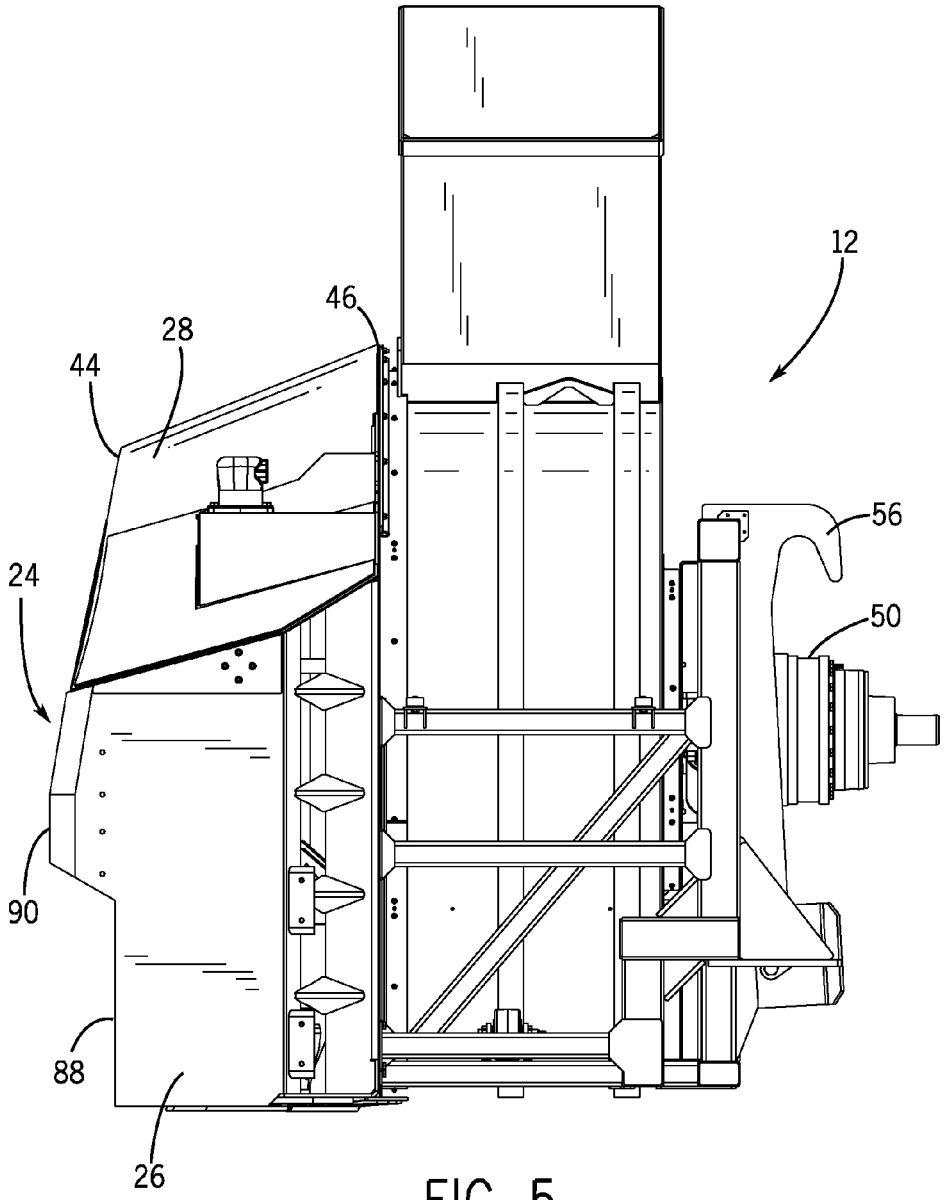
FIG. 5 is a side view of the snowblower assembly.

As shown in FIG. 5, the upper hood 28 of the snowblower housing 24 generally extends from an upper leading edge 44 to a trailing edge 46. As illustrated in FIG. 4, the height of the trailing edge 46 above the ground is greater than the height of the leading edge 44 such that the upper hood 28 slopes downwardly from the trailing edge 46 to the leading edge 44. As can be understood in FIG. 2, the sloped upper hood 28 provides enhanced visibility for the operator of the vehicle 14 positioned in the cab 16. Since the upper hood 28 slopes downwardly from the trailing edge 46 to the leading edge 44, the operator of the cab is provided with increased visibility of the pavement being cleared of snow as compared to an embodiment in which the leading edge 44 is at the same height as the trailing edge 46. The height of the trailing edge 46 must be at least as high as the top edge of the impeller 34, as can be seen in FIG. 4. The impeller 34 of the illustrated embodiment has a diameter of 82 inches, which is much larger than prior snowblowers. The increased diameter of the impeller increases the height of the trailing edge 46 as compared to prior snowblowers. Thus, since the height of the trailing edge 46 is fixed, the height of the leading edge 44 is decreased to provide enhanced visibility for the operator.

Figure 7:
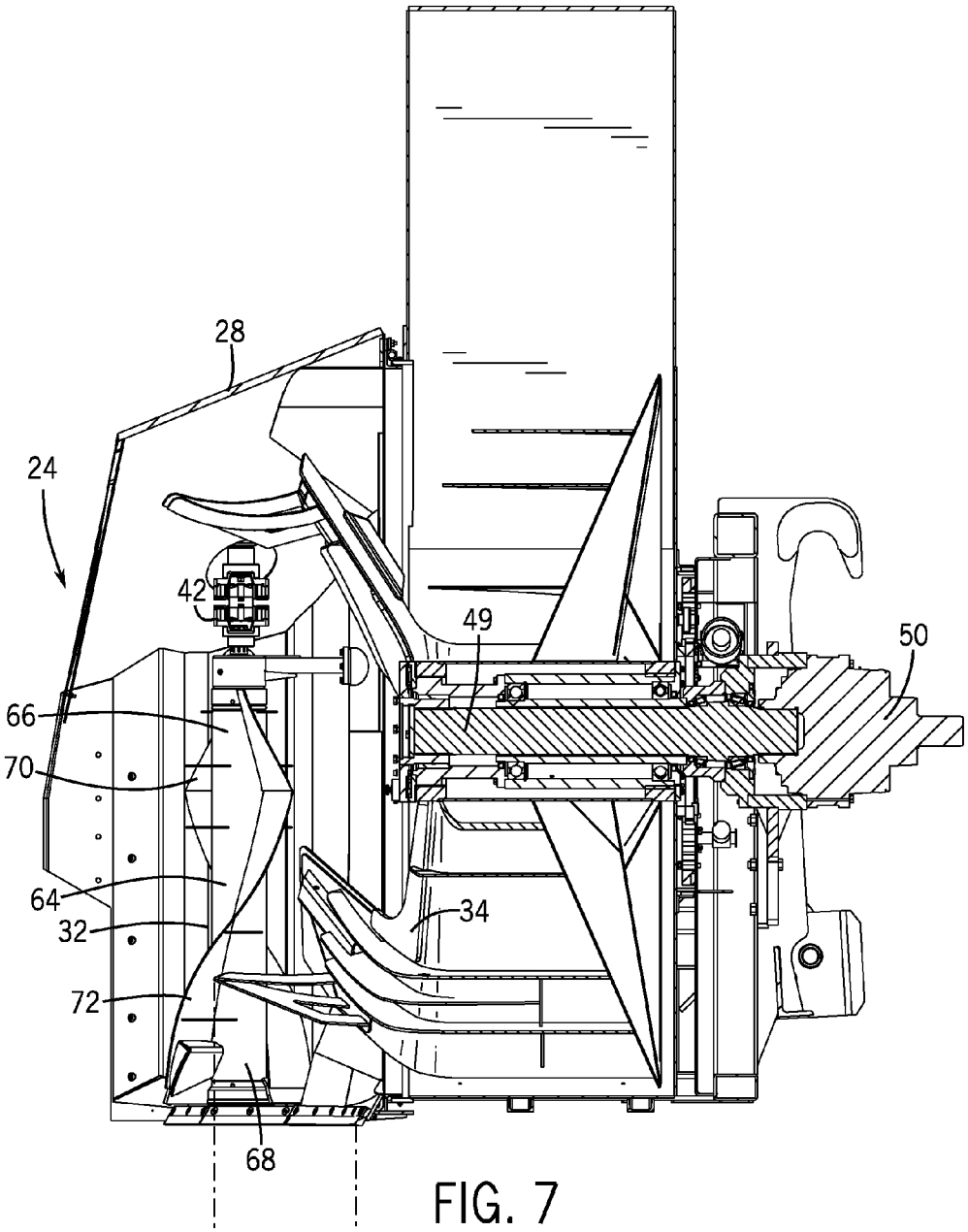
FIG. 7 is a section view of the snowblower assembly.

Referring now to FIG. 7, the impeller 34 is mounted to a center driveshaft 49 that extends into a planetary gear reduction unit 50. The planetary gear reduction unit 50 is received by a propeller shaft assembly at the front end of the vehicle (not shown) and receives power from an auxiliary diesel engine mounted on the vehicle. The auxiliary diesel engine mounted on the vehicle operates to only drive the impeller 34 through the driveshaft 49, planetary gear reduction unit 50, propeller shaft assembly, and integrated power take off/two speed transfer case assembly. As described previously, the vertical auger drive motors 42 are each hydrostatic motors that receive pressurized hydraulic fluid from the diesel engine which drives the chassis of the vehicle 14. Thus, the power source used to drive each of the augers 32 is separate from the power source used to rotate the impeller 34.

Referring now to FIG. 3, the lower leading edge 30 of the snowblower housing is defined by a cutting edge 52 that extends between the sidewalk 26 of the snowblower housing 24. The cutting edge 52 directs snow upward and into the open interior 25 of snowblower housing 24. The shape of the leading edge 30 helps to direct snow toward the rotating impeller 34.

As illustrated in FIG. 4, each of the hydrostatic drive motors 42 are located above the upper hood 28 such that the drive motors 42 are positioned away from the open interior 25 of the snowblower housing 24 which receives snow being removed from the pavement. Each of the hydrostatic drive motors 42 receives hydraulic fluid through a pressurized hydraulic supply line such that the vertical side augers 32 are rotated to direct snow toward the center impeller 34. In the embodiment illustrated in FIG. 4, each of the chive motors 42 are mounted to a support block 48 that extends above the outer surface of the upper hood 28. Each of the support blocks 48 provides a secure point of attachment for the drive motor 42 such that the drive motor 42 can be positioned outside of the open interior 25.

As illustrated in FIG. 5, the snowblower assembly 12 includes a pair of attachment hooks 56 that allow the entire snowblower assembly 12 to be supported on the front end of the operating vehicle 14. The gear reduction unit 50 interacts with a drive assembly of the vehicle to provide the motive force to rotate the center impeller, as described.

Referring now to FIG. 3, inside the snowblower housing the back wall 35 extends between the auger 32 and the rotating impeller 34. The back wall 35 is angled toward the impeller 34 to further direct snow toward the rotating impeller 34.

FIGS. 4 and 7 illustrate the pair of side augers 32 that each are independently rotatable by one of the drive motors 42. Each of the side augers 32 includes a center shaft 64 that rotatably extends between the upper hood 28 and a bottom wall of the snowblower housing 24. The center shaft 64 is generally divided into an upper portion 66 and a lower portion 68. The upper portion 66 includes an auger blade 70 while the lower portion 68 includes an auger blade 72. The upper auger blade 70 and the lower auger blade 72 have different configurations and orientations such that the upper portion 66 and the lower portion 68 of the side augers 32 perform different functions.

Specifically, the lower auger blade 72 is configured such that rotation of the side auger causes the lower auger blade 72 to direct snow slightly upward and toward the center of the open interior 25 for discharge by the rotating impeller 34. The upper auger blades 70 have a different configuration and are designed to fling snow toward the center of the open interior and away from the upper hood 28. The function of both the upper and lower auger blades 70, 72 is to direct snow away from the sidewalls 26 and toward the center of the open interior 25. Further, both of the auger blades 70, 72 are configured to direct snow toward the rotating impeller for discharge. Since the snowblower assembly 12 of the present disclosure is typically used in clearing large runways, it is important for all of the snow from the runway to be removed during a single pass of the snowblower. Thus, the pair of rotating side augers 32 functions to direct snow that may not initially be removed by the rotating impeller 34 back into contact with the rotating impeller for ultimate removal.

Figure 6:
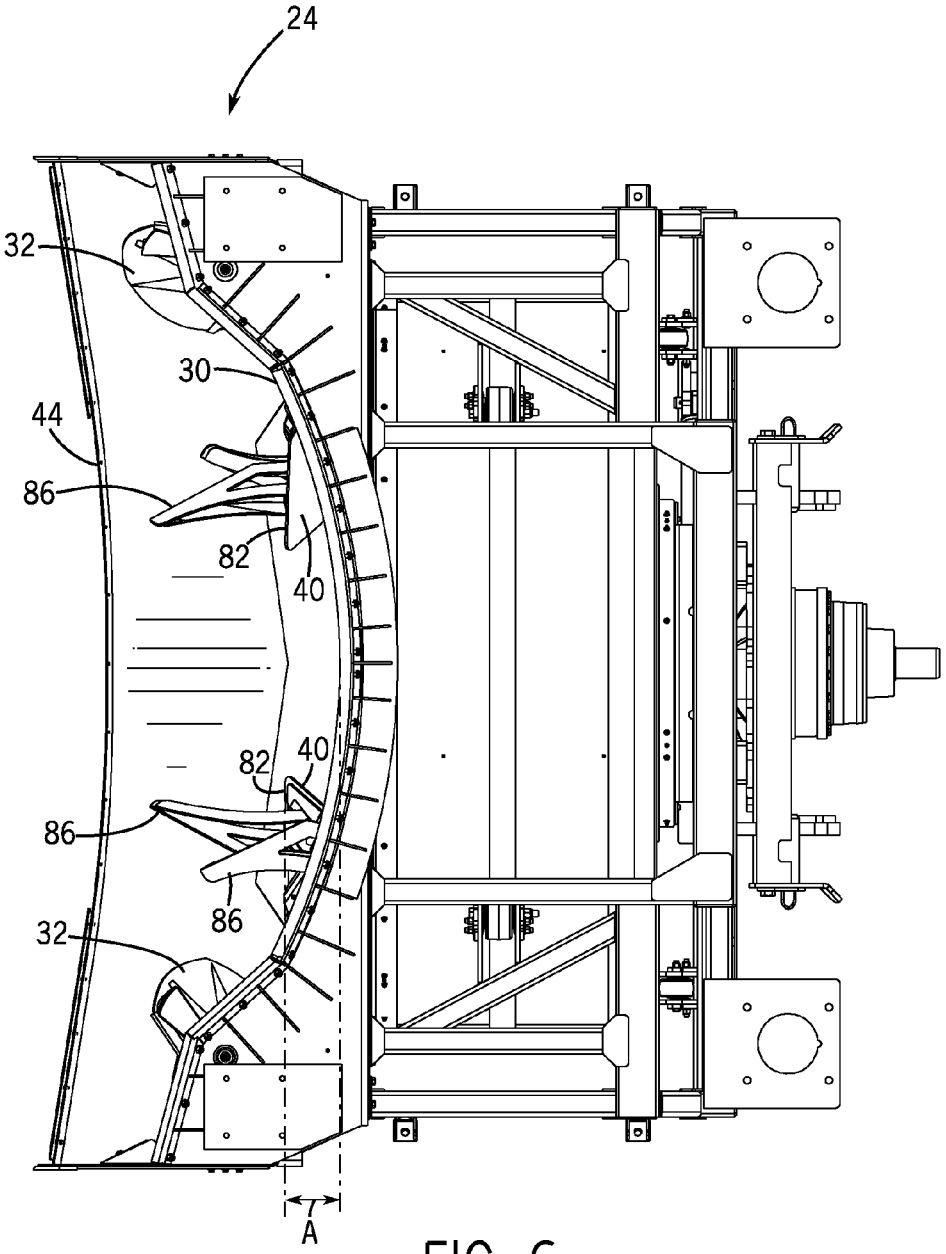
FIG. 6 is a bottom view of the snowblower assembly.

As illustrated in FIGS. 3 and 6, each of the impeller blades 34 extends away from a conically shaped back plate 80 to a blade tip 82. As can best be seen in FIG. 6, the snowblower housing 24 of the present disclosure is specifically designed such that the lower leading edge 30 is recessed well behind the upper leading edge 44 that is part of the upper hood 28. Specifically, the blade tips 82 extend forward from the most recessed portion of the lower leading edge 30 by a distance A shown in FIG. 6. The lower leading edge 30 is designed to be behind the blade tips 82 by the distance A to ensure that the impeller blades gather and process the snow prior to the snow coming into contact with the lower leading edge 30. The recessed lower leading edge 30 increases the volume of snow that can be processed by the snowblower assembly and is especially useful when clearing relatively wet, high density snow that would otherwise have a tendency to build up on and in front of the lower leading edge 30 if it were not recessed. For this reason, the lower leading edge 30 has been designed to be recessed behind both the impeller blades 34 as well as behind the auger blades of each of the side augers 32.

In the embodiments shown in FIGS. 3 and 6, each of the impeller blades includes an additional pre-cutter knife 86 mounted to the outside face of the impeller blades that is used to further aid in cutting snow before the snow is gathered and processed by the inside face of the impeller blades. The pre-cutter knives are particularly useful in breaking down relatively wet, high density, hard-packed, or frozen snow. The pre-cutter knives 86 are mounted to the outside face of the impeller blades in a staggered position. Specifically, two opposite pre-cutter knives are positioned near the leading tip, along the top edge, of the impeller blades 82, and two opposite pre-cutter knives 86 are positioned further away from the leading tip, along the bottom edge, of the impeller blades 82. By staggering the position of the pre-cutter knives, the pre-cutter knives 86 work at two different heights from the pavement surface as the impeller rotates. That is, the pre-cutter knives 86 positioned further away from the leading tip, along the bottom edge, of the impeller blades handle snow near the pavement surface as the impeller rotates, while the pre-cutter knives positioned near the leading tip, along the top edge, of the impeller blades handle snow several inches higher than the other pre-cutter knives as the impeller rotates. In an alternative configuration, each of the pre-cutter knives 86 may be positioned away from the leading tip of the impeller blades 82, along the bottom edge of the respective impeller blades.

The sidewalls 26 of the snowblower assembly have been designed to further enhance the effectiveness of the side augers 32, especially in processing relatively wet, high density snow. As illustrated in FIG. 5, each of the sidewalls 26 has been designed to include a lower sidewall edge 88 that is recessed from an upper sidewall edge 90. The recessed configuration of the lower sidewall edge 88 relative to the upper sidewall edge 90 works to limit the accumulation of snow in the corners of the snowblower assembly, that is, the area directly in front of the side augers 32. The accumulation of snow limits the effectiveness of the side augers and impedes the flow of snow into contact with the center rotating impeller. The upper sidewall edge 90, as shown in FIG. 5, protrudes out slightly past the leading edge 44 of the hood 28 to help retain snow within the snowblower housing 24 as it is processed by the rotating impeller.

As illustrated in FIG. 6, the rotating center impeller has multiple impeller blades 40 that extend outwardly in the direction of movement of the snowblower relative to the recessed lower leading edge 30. The extended configuration of the impeller blades 40 cause each of the impeller blades to rotate very close to the side augers 32, as illustrated in FIG. 4. Since each of the impeller blades 40 have been extended to maximize the volume of snow that can be processed during operation, in accordance with the present disclosure, the lower auger blades 72 of the pair of side augers 32 have been designed to have a tapered configuration. Specifically, the width of the auger blade 72 extending from the center shaft 64 to the outer edge 92 decreases from the lower end 94 to the upper end 96. Thus, as the auger blade 72 vertically approaches the widest portion of the impeller 34, the width of the blade 72 decreases to prevent contact between the rotating auger blade 72 and the impeller blades 40.

Figure 9:
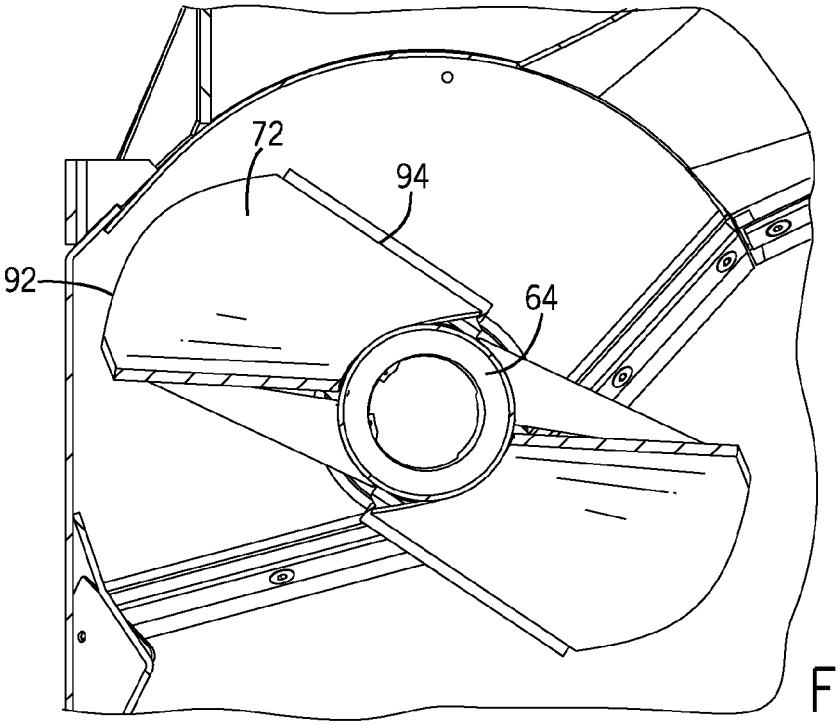
FIG. 9 is a view taken along line 9-9 of FIG. 4.

FIG. 9 illustrates a cross section taken through the side auger 32 that illustrates the tapered shape of the auger blade 72 from the lower end 94 towards the upper end. The tapered configuration of the auger blade 72 allows the side auger to be used with the impeller 34 shown in FIG. 4 having impeller blades 40 that extend further from the back wall.

Figure 8:
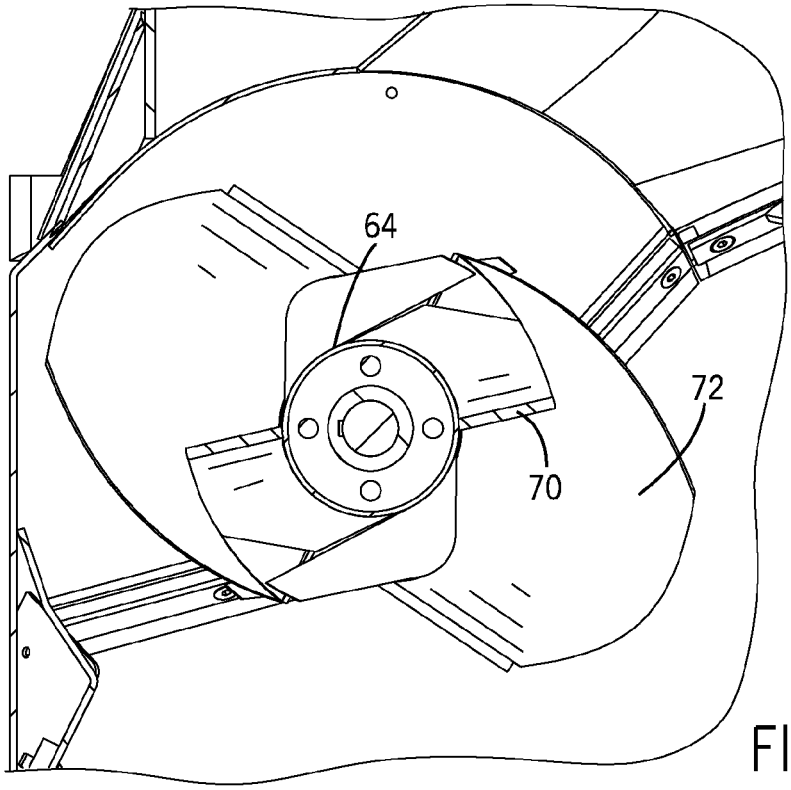
FIG. 8 is a view taken along line 8-8 of FIG. 4.

FIG. 8 illustrates the configuration of the upper auger blades 70 formed on the upper portion of the side auger. The auger blade 70 also decreases from a top end 98 to a lower end. Once again, the tapered configuration of the auger blade 70 prevents contact with the rotating impeller blades.

As described previously with reference to FIG. 5, the snowblower assembly 12 of the present disclosure has been designed having sidewalls 26 including a removed portion near the lower end that defines a recessed lower sidewall edge 88. The recessed lower sidewall edge 88 has proven to be particularly useful when utilizing the snowblower assembly with relatively wet, high density snow. However, when the snowblower assembly 24 is used with relatively dry, low density snow, it is desired to provide as complete of an enclosure as possible to entrap the light weight snow within the snowblower housing 24.

Figure 10:
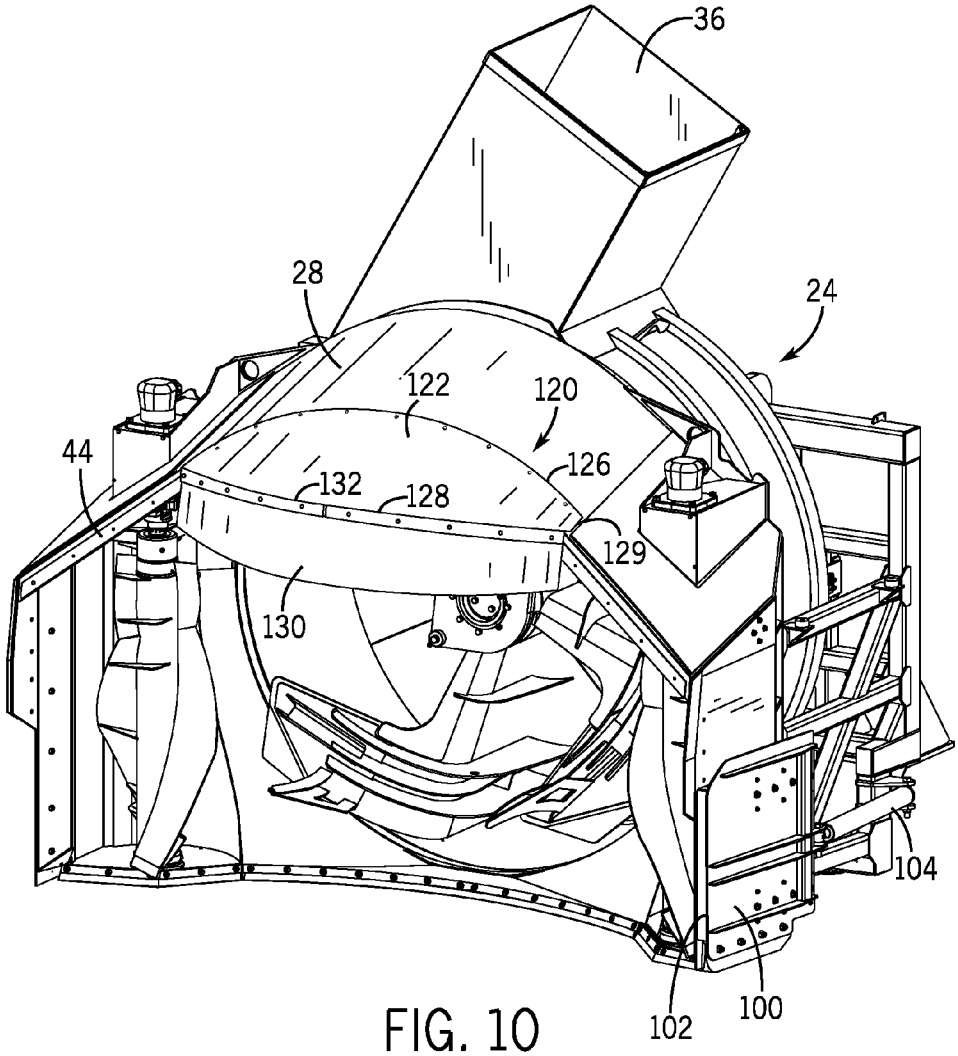
FIG. 10 is a front perspective view of an alternate embodiment of the snowblower assembly including adjustable side plates.
Figure 11:
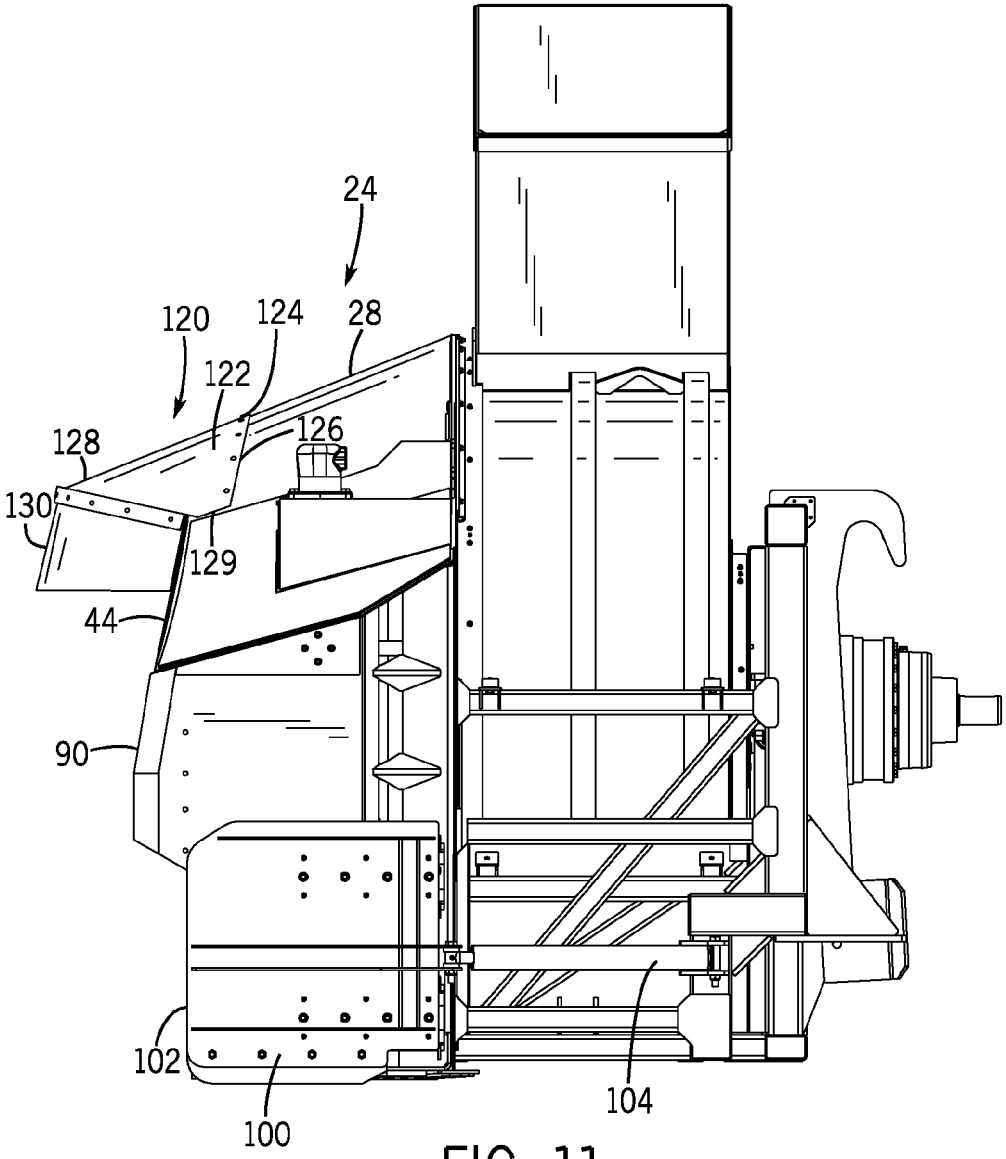
FIG. 11 is a side view of the alternate embodiment showing the side plates in a retracted position.
Figure 12:
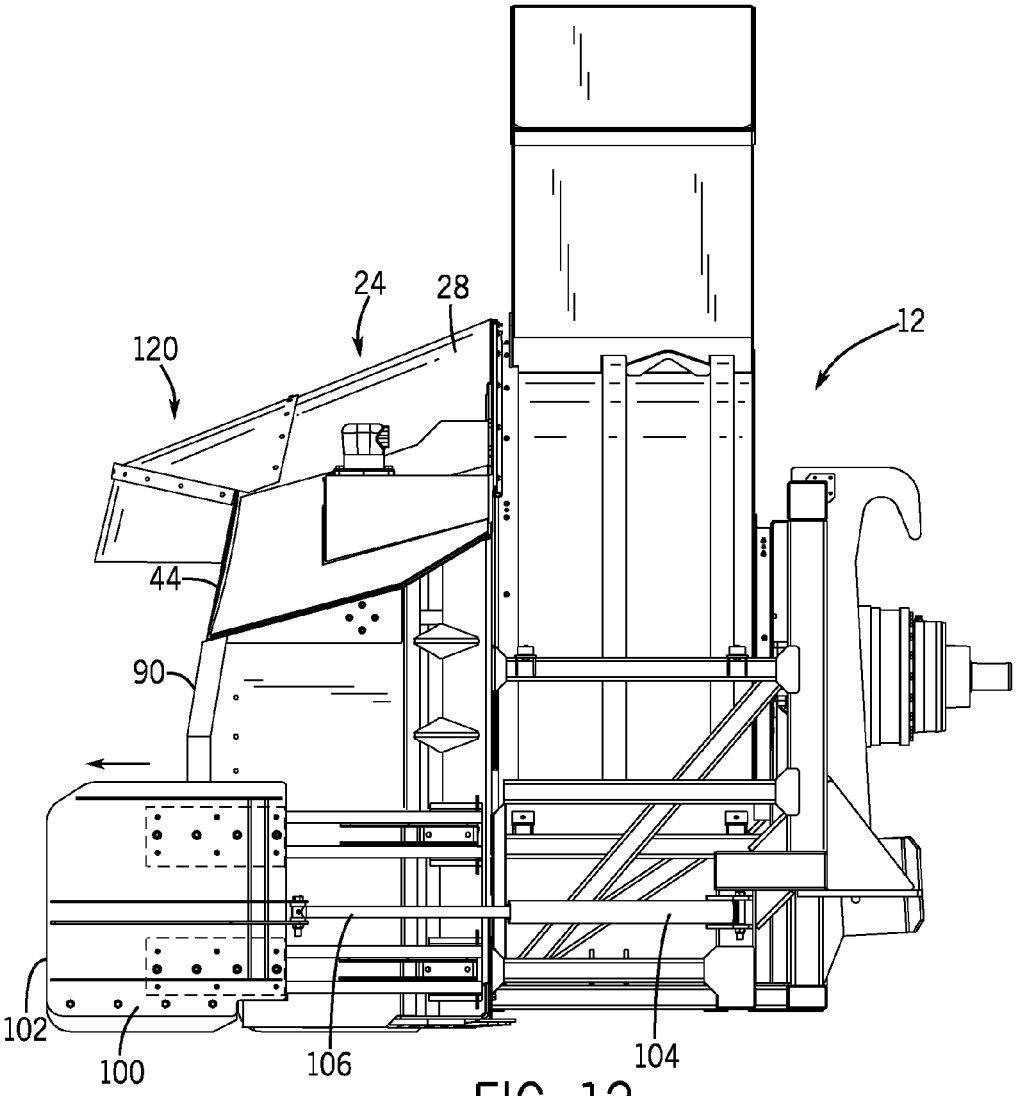
FIG. 12 is a side view of the alternate embodiment illustrating the extension of the side plates to an extended position.

In accordance with the present disclosure, the snowblower housing 24 has been designed including a pair of retractable side plate extensions 100, as shown in FIGS. 10-12. Each of the side plate extensions 100 is a plate-like member having a leading edge 102. The side plate extension 100 is connected to a drive member, such as a hydraulic cylinder 104. The hydraulic cylinder 104 is connected to a supply of hydraulic fluid such that the cylinder can be actuated to both extend and retract a piston rod 106. When the piston rod 106 is extended, the leading edge 102 of the side plate extension 100 extends past the upper sidewall edge 90 to further entrap snow within the snowblower housing. Likewise, when the snowblower housing is used with wet, high density snow, the piston rod 106 is retracted, as shown in FIG. 11, to position the leading edge 102 behind the upper sidewall edge 90 as illustrated in FIG. 11.

It is contemplated that a side plate extension 100 could be positioned on one or both sides of the snowblower assembly 12. In a preferred embodiment, each side plate extension 100 can be separately extended depending upon the user requirements. As an example, in certain situations, the operator of the snowblower may wish to only extend one of the two side plate extensions 100 depending upon the snow removal requirements. In such an embodiment, the user could extend one of the side plate extensions 100 while allowing the other, opposite side plate extension to remain in its retracted position.

In addition to the pair of retractable side plate extensions 100, the embodiment of the snowblower housing shown in FIGS. 10-12 can be configured to include a cowl assembly 120 that is mounted to the upper hood 28. The cowl assembly 120 extends past the leading edge of the upper hood 28 to prevent snow from leaving the blower housing 24 and blowing upward directly into the windshield of the truck used to propel the blower assembly. The cowl assembly 120 has been found to be particularly useful when the blower assembly is used to remove very slushy, wet snow.

As illustrated in FIG. 11, the cowl assembly 120 includes an extending cowl 122 that is attached to the upper hood 28 through a series of connectors 124. The cowl 122 generally conforms to the curvature of the upper hood 28 and extends from a rear edge 126 to an outer edge 128. As can be seen in FIG. 11, the outer edge 128 extends past the leading edge 44 of the upper hood 28. As illustrated in FIG. 10, the outer edge 128 is generally curved such that the outer edge 128 extends furthest from the upper hood 28 at its mid-portion while the opposite ends 129 of the outer edge 128 come into contact with the upper hood 28.

As illustrated in FIGS. 10 and 11, a deflector shield 130 is attached to the outer edge 128 of the cowl 122 by a second series of connectors 132. The deflector shield 130 extends in a generally vertical direction and aids in deflecting slush and snow back into the blower housing.

As illustrated in FIGS. 10-12, the cowl assembly 120 extends the upper hood 28 away from the vehicle such that the blower assembly can better contain very wet/slushy snow that may otherwise be deflected upward and over the leading edge of the upper hood 28 and into the vehicle windshield. Although the cowl assembly 120 is particularly useful when moving wet/slushy snow, the cowl assembly 120 will also help contain relatively dry snow that has a tendency to blow up over the top of the hood and into the vehicle windshield.

Although side plate extensions 100 and the cowl assembly 120 are both shown in the embodiment of FIGS. 10-12, it should be understood that the side plate extensions and/or the cowl assembly 120 could be removed from the snowblower housing while operating within the scope of the present disclosure.

Figure 13:
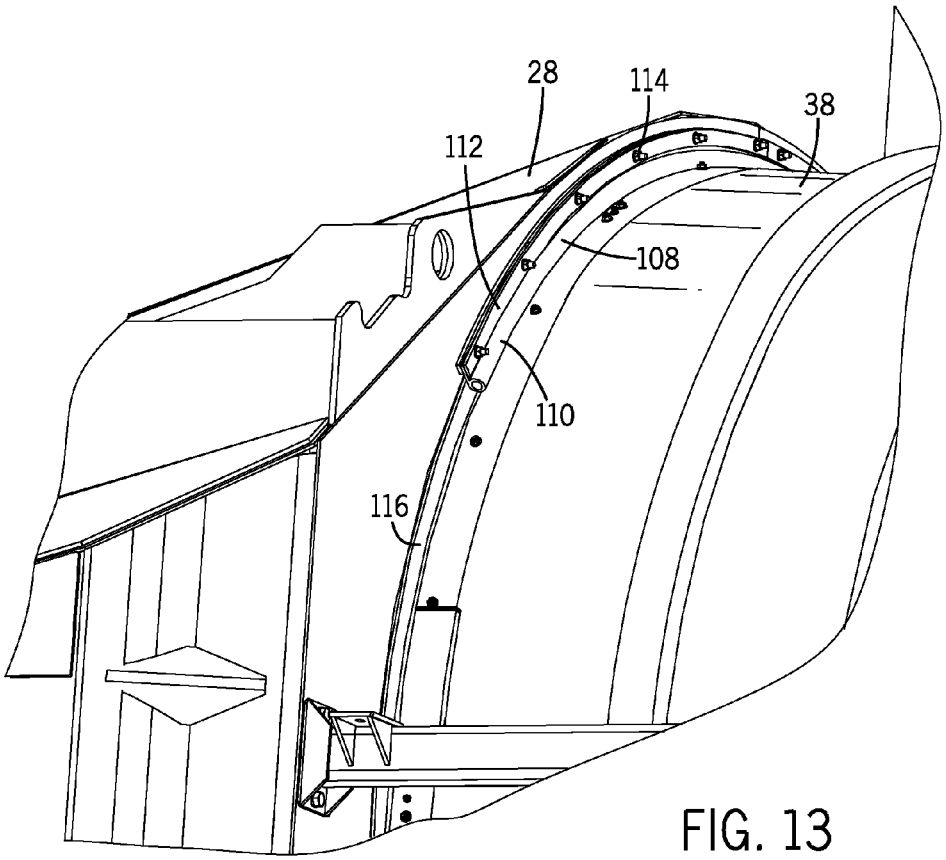
FIG. 13 is magnified view illustrating a sealing assembly.

Referring now to FIG. 13, dining use of the snowblower assembly of the present disclosure in high snow environments, the high volume of snow moving within the interior defined by the snowblower assembly has been able to pass between the point of connection between the snowblower hood 28 and the volute assembly 38, as illustrated in FIG. 13. When the snowblower is moving at a relatively high speed, the snow passing through the seam formed between the upper hood 28 and the volute assembly 38 can create visibility problems. To solve this problem, the assembly of the present disclosure includes a snow containment gasket 108. As illustrated in FIG. 13, the gasket includes a lower bead 110 connected to an attachment portion 112. The attachment portion 112 is secured to the snowblower assembly through a series of connectors 114. The bead 110 prevents snow from passing through the seam 116 and thus increases the visibility for the operator. Although the gasket is shown in the embodiment of FIG. 13, it should be understood that the gasket could be removed while operating within the scope of the present disclosure.

In an alternative configuration, a rolled steel strip may be welded to the rim of the round opening at the rear of the snowblower housing 24. The rolled steel strip serves to overlap the seam formed between the snowblower housing 24 and the volute assembly 38 such that snow or slush is prevented from passing between the open area between the snowblower housing and the volute assembly.

As described, the speed of movement of the snowblower and the shape of the bottom section of the snowblower enclosure is such that the snow is directed from the pavement surface to the impeller 34 located at the rear of the snowblower housing 24. Likewise, the snow that enters the snowblower housing 24 on opposite sides of the impeller 34 is directed slightly upward and toward the center of the snowblower housing 24 by the side augers 32, where the snow is ingested by the impeller 34. Since the snow is handled by both the side augers 32 and the center impeller 34, some turbulence is created, and a certain amount of residual snow that does not immediately exit the snowblower enclosure through the volute assembly 38 and discharge chute 36 may otherwise be thrown out the front or sides of the snowblower enclosure.

Specifically, as the snowblower vehicle moves in a forward direction on a snow-filled runway, there is a natural tendency for some of the snow to otherwise get pushed to the sides of the snowblower assembly. In addition, a certain amount of snow being handled by the side augers and the center impeller has a tendency to be pushed forward and out of the snowblower housing. The pair of side frame extensions 74 function to increase the physical volume of the snow that can be held within the open interior 25 of the snowblower housing to keep snow contained within the snowblower housing to be processed by the rotating impeller. As described above, the upper hood 28 and the side frame extensions 74 work together to contain snow within the interior 25 of the snowblower housing while the snowblower is traveling in a forward direction, thereby increasing overall performance and reducing the amount of residual snow that is left on the runway surface during the snow removal operation.

We claim:

1. A vehicle-mounted snowblower assembly for movement in a forward direction for removing snow, comprising:

a snowblower housing having a pair of spaced sidewalls, an upper hood extending between the sidewalls and a lower leading edge, wherein the spaced sidewalls and the upper hood of the snowblower housing define an open interior that receives snow to be removed;

a rotating impeller contained within the open interior of the snowblower housing, the impeller having a plurality of impeller blades each having a blade tip, wherein the blade tips extend past the lower leading edge of the snowblower housing; and a pair of side augers each rotatable about a vertical axis and mounted within the open interior of the snowblower housing on opposite sides of the impeller, each of the side augers including an auger blade that extends past the lower edge of the snowblower housing, wherein the upper hood includes an upper leading edge, wherein each of the sidewalls and the upper leading edge extend past the blade tips, the auger blades of the pair of side augers and the lower leading edge in the forward, direction.

2. The vehicle-mounted snowblower assembly of claim 1 wherein each of the side augers includes an auger blade that extends away from a center shaft, wherein the length of the auger blade from the center shaft varies.

3. The vehicle-mounted snowblower assembly of claim 2 wherein the length of the auger blade decreases from a lower end to an upper end.

4. The vehicle-mounted snowblower assembly of claim 1 further comprising a pre-cutter knife attached to an outer surface of each of the impeller blades, wherein each of the pre-cutter knives extends past a blade tip of the impeller blades in the forward direction.

5. The vehicle-mounted snowblower assembly of claim 4 wherein the pre-cutter knives are each removably attached to one of the impeller blades.

6. The vehicle-mounted snowblower assembly of claim 1 further comprising a cowl assembly attached to only a portion of the upper hood, wherein the cowl assembly extends past the upper leading edge of the upper hood.

7. The vehicle-mounted snowblower assembly of claim 1 wherein the upper hood defines an upper leading edge, wherein a cowl assembly is attached only to a portion of the upper hood and extends past the upper leading edge.

* * * * *